United States Patent [19]

Cutts

[11] 4,319,392

[45] Mar. 16, 1982

[54] REMOVING RAIL CLIPS FROM A RAILWAY TRACK

[75] Inventor: Glynn D. Cutts, Sheffield, England

[73] Assignee: Pandrol Limited, London, England

[21] Appl. No.: 56,434

[22] Filed: Jul. 10, 1979

[30] Foreign Application Priority Data

Jul. 18, 1978 [GB] United Kingdom ..... 30271/78

[51] Int. Cl.[3] ..... B23P 6/00; B23P 19/02; B23P 19/04

[52] U.S. Cl. ..... 29/402.08; 29/244; 29/270; 29/426.5; 104/1 R; 104/17 A; 173/24

[58] Field of Search ..... 104/1 R, 2, 7 R, 16, 104/17 R, 17 A; 192/138, 143; 173/24; 29/426.1, 426.5, 244, 270, 402.03–402.08

[56] References Cited

U.S. PATENT DOCUMENTS 4,068,593 1/1978 Leeves ..... 104/1 R

FOREIGN PATENT DOCUMENTS 1581071 9/1969 France ..... 104/7 R
1494514 12/1977 United Kingdom ..... 104/1 R

*Primary Examiner*—Randolph A. Reese
*Attorney, Agent, or Firm*—Norbert P. Holler

[57] ABSTRACT

A trolley runs along a railway track and a member on it strikes railway clips and removes them from rail-securing positions. The clips are of a kind having a first portion substantially parallel to the rail and driven into a projection beside the rail, a second portion bearing downwardly on the rail flange and a third portion, further from the rail than the first portion, bearing downwardly on an unyielding surface.

10 Claims, 3 Drawing Figures

REMOVING RAIL CLIPS FROM A RAILWAY TRACK

Figure 1:
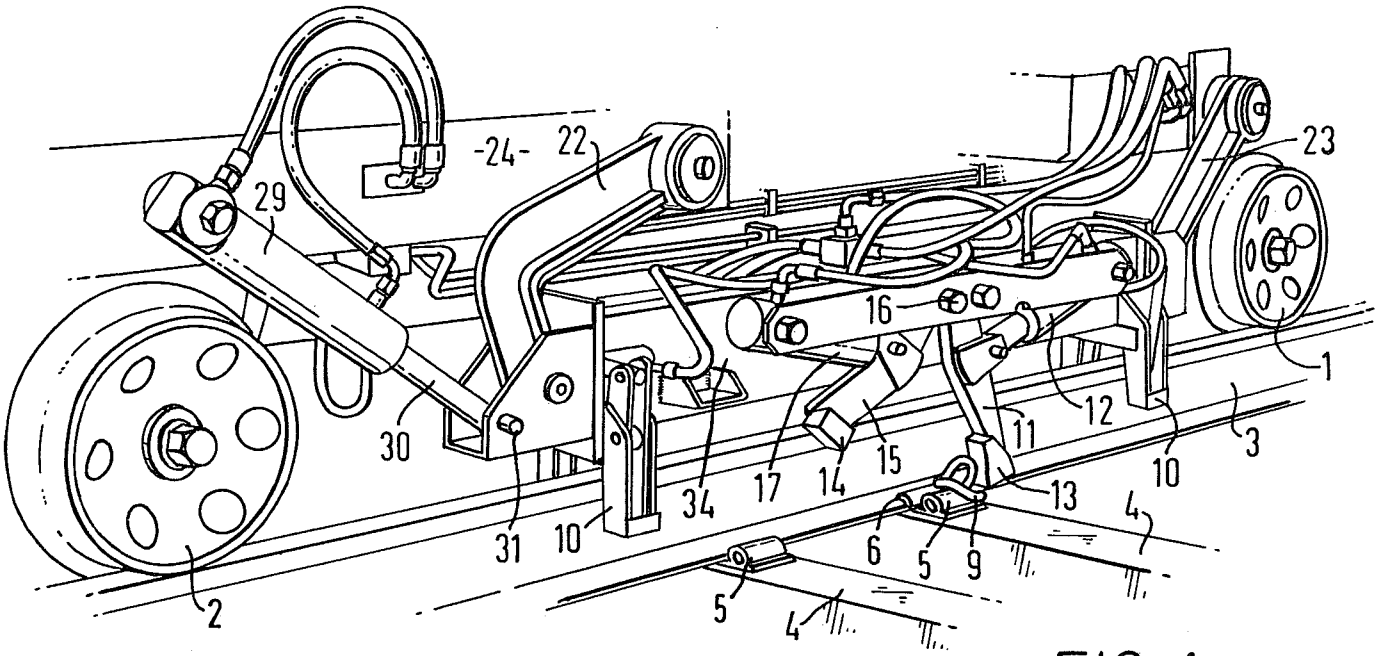

This invention relates to a railway track comprising two rails each having, at intervals along it, two upwardly-extending projections on opposite sides of the rail for locating the rail, at least one of each two projections having driven into it a first portion of a rail clip, which first portion is substantially parallel to the rail, the clip having a second portion bearing downwardly on the top of a flange of the rail, a third portion bearing downwardly on an unyielding surface which is on that side of the first portion of the clip remote from the rail, a fourth portion interconnecting said first portion of one of said second and third portions, and a fifth poriton interconnecting said second and third portions, at least one of said fourth and fifth portions extending above said upwardly-extending portion. Examples are shown in the specifications of British Pat. Nos. 861,473, 968,659 and 1,213,762.

According to a first aspect of the invention, there is provided a device suitable for use in removing rail clips from rail-securing positions in a railway track of the kind specified, comprising a trolley constructed to run on at least one rail of the track and carrying a member which is adjustable to a position such that when the trolley runs along the track in the appropriate direction the member strikes all the clips on one side of one of the rails and forces their first portions out of the projections, the member being fixed, or having means for fixing it, so that it does not move to any substantial extent relatively to the trolley when it strikes one of the clips.

According to a second aspect of the invention, there is provided a device suitable for use in removing rail clips from rail-securing positions in a railway track of the kind specified, comprising a trolley constructed to run on at least one rail of the track and carrying a member which is adjustable to a position such that when the trolley runs along the track in the appropriate direction the member strikes all the clips on one side of one of the rails and forces their first portions out of the projections, the trolley carrying actuating means for moving said member out of said position to a second position in which it could not strike the clips when the trolley runs along the track and means for disabling said actuating means when required so that, despite operation of said actuating means in a sense tending to move said member out of the first position to the second position, it does not move to the second position.

According to a third aspect of the invention, there is provided a device suitable for use in removing rail clips from rail-securing positions in a railway track of the kind specified, comprising a trolley constructed to run on at least one rail of the track and carrying two members which lie on opposite sides of one of the rails when the device is running along the track, each of these members being adjustable to a first position such that when the trolley runs along the track in the appropriate direction, which in the case of one member is opposite to the direction which is appropriate for the other member, the member strikes all the clips on one side of one of the rails and forces their first portions out of the projections, there being actuating means which is capable of moving both said members simultaneously in opposite directions out of the first positions to second positions in which they could not strike the clips when the trolley runs along the track and means for, when required, disabling the actuating means in so far as it acts upon one of the members, so that that member does not move to the second position.

Said member, in the case of the second aspect of the invention, or said one of the members, in the case of the third aspect of the invention, may remain in the first position, when the disabling means is used, and not move to any substantial extent relatively to the trolley when it strikes one of the clips, or it may, when it strikes one of the clips, move substantially, for example against a spring force or against the braking effect of a hydraulic damping arrangement, but not so as to attain a position, such as the second position, relative to the trolley, such that it would not strike clips when the trolley runs along the track.

In a device according to the third aspect of the invention, the actuating means may comprise a first piston-and-cylinder device coupled to one of the members to move it between the first and second positions, a second piston-and-cylinder device coupled to the other member to move it between the first and second positions and means for supplying fluid at pressure to both piston and cylinder device simultaneously, so that they tend to operate in unison to move the members from the first positions to the second positions, and abutment means for preventing one of the members from being moved by its piston-and-cylinder device.

In a device according to the third aspect of the invention, each of said members may move between the first and second positions by swinging about an axis which is horizontal and extends across the track perpendicularly to it.

In a sample form of device according to the first aspect of the invention, said member can move vertically upwardly to its second position and downwardly to its first position and can at no time move in any other way.

According to a fourth aspect of the invention, there is provided a device suitable for use in removing rail clips from rail-securing positions in a railway track of the kind specified, comprising a trolley constructed to run on at least one rail of the track and carrying a member which is adjustable to a position such that when the trolley runs along the track in the appropriate direction the member strikes all the clips on one side of one of the rails and forces their first portions out of the projections, the member being mounted on a structure to which first and second swinging parts are pivotally connected, the first and second swinging parts also being pivotally connected to the trolley, the pivot axes of these four pivotal connections all being parallel and being such as to intersect an imaginary plane, perpendicular to the axes, at points which lie at the corners of a parallelogram, whereby when the first and second swinging parts are swung about the axes of their pivotal connections to the trolley said member is raised and lowered so that it can be adjusted to the first position.

A device according to any of the above-mentioned aspects of the invention may carry means for driving the first portions of the clips into the projections.

According to a further aspect of the invention, a method of removing rail clips from rail-securing positions in a railway track of the kind specified is provided, in which a device according to any of the first, second, third and fourth aspects of the invention is employed and runs along the track forcing the first portions of the clips out of the projections.

According to another aspect of the invention, there is provided a method of improving a railway track of the kind specified in which a device according to any of the first, second, third and fourth aspects of the invention is employed and runs along the track forcing the first portions of the clips out of the projections, part of the assembly on the track is adjusted, repaired or replaced and then the same clips or other clips are driven back into the projections.

Figure 2:
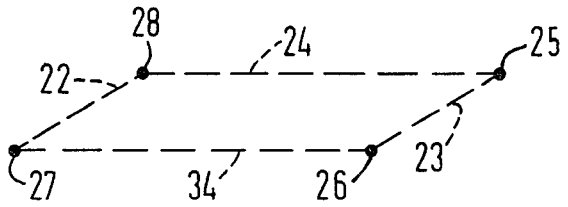
Figure 3:
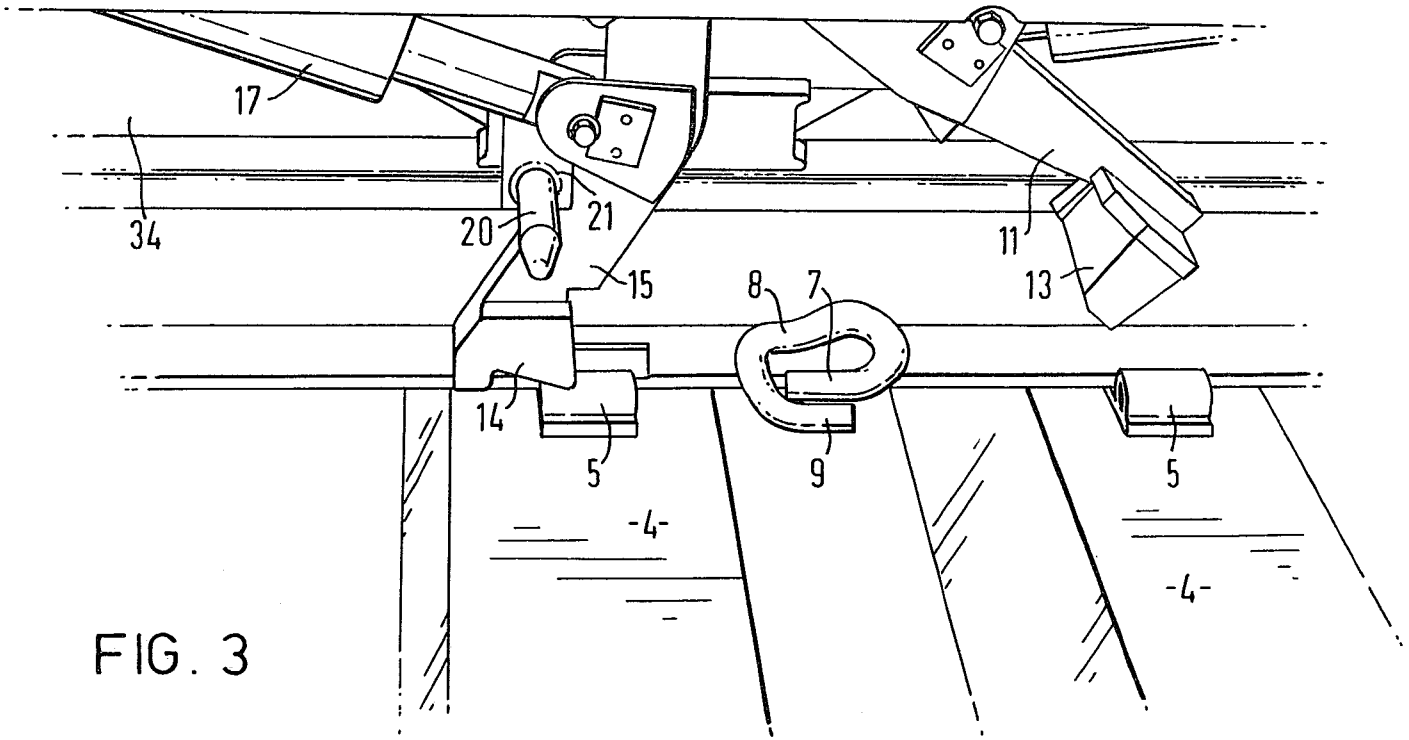

An example in accordance with all the above-mentioned aspects of the invention is described below with reference to the accompanying drawing, in which:

FIG. 1 shows a perspective view, from the rear and one side, of a device suitable for use in removing rail clips from rail-securing positions in a railway track of the kind specified, FIG. 2 diagrammatically illustrates pivot axes in the device of FIG. 1, and FIG. 3 shows an enlarged view, from the same side, of the device of FIG. 1, with some parts of it in positions different from those shown in FIG. 1.

The illustrated device comprises a trolley having a front wheel 1 and a rear wheel 2 which run on one rail 3 of a railway track. It also has, although this is not shown, a further front wheel and a further rear wheel which run on the other rail of the track. The rails are laid across concrete railway sleepers 4 in each of which there are incorporated four anchorage members each of which affords an upwardly extending projection 5 through which there is a passageway extending parallel to the rail. On any one sleeper, two of the projections 5 lie on opposite sides of one rail and locate that rail and the other two projections 5 lie on opposite sides of the other rail and locate that rail. The rails stand on pads of electrically insulating material and insulators 6 each have a portion which lies between an edge of the flange of the rail and an adjacent projection 5 and a portion which lies on the rail flange. A first portion 7 of a clip according to British Pat. No. 861,473 is driven into the passageway in one of the projections 5, a second portion 8 of the same clip bears downwardly on that part of the insulator 6 which lies on the rail flange and a third portion 9 of the clip bears downwardly upon a fixed, unyielding surface which, as seen, from the rail, is beyond the first portion 7 of the clip, this unyielding surface being provided by the above-mentioned anchorage member. The assembly of the sleeper 4, the anchorage member, the pad, the rail, the insulator and the clip is as shown in British Pat. No. 968,659. On the side of the rail 3 which is not visible in FIGS. 1 and 3 there are above each sleeper, another insulator 6 and another clip but whereas the free end of the portion 7 of the illustrated clip points to the left, the free end of the clip on the other side of the same rail points to the right.

The trolley carries grippers 10 which are actuated by hydraulic piston-and-cylinder devices to grip only the rail 3 or both rails. The trolley also carries arms 11 which are operated by hydraulic piston-and-cylinder devices 12 which can, for example, swing clockwise the illustrated arm 11 to cause a pad 13 on the lower end of it to push a clip so that the first portion 7 of it is driven into the passageway through the illustrated projection 5. The arm 11 can also be swung anti-clockwise so that it does not strike any clips or projections 5 when the trolley runs along the rails.

The trolley also carries four members 14 on the lower ends of arms 15 which are pivotally mounted at 16 to swing about axes which are horizontal and perpendicular to the length of the railway track. The members 14 can occupy positions such that two of them are on opposite sides of, and close to, one rail and the other two are on opposite sides of, and close to, the other rail. These positions are referred to below as "first" positions. If all of the members 14 were simultaneously in the first positions, they would all strike clips as the trolley travelled along the railway track, but this does not in fact happen because they are never all simultaneously in the first positions when the trolley is travelling along the track. There are four piston-and-cylinder devices 17, one for each arm 15, and fluid at pressure can be supplied simultaneously to all four of them, tending to swing all four arms 15 simultaneously, two in the clockwise direction and two in the anti-clockwise direction, to raise the members 14 so that they cannot strike clips as the trolley moves along the railway track. It is to be noted here that the arm 15 and member 14 on the nearer side of the rail that is not illustrated are directly behind the arm 15 and member 14 which are shown in the drawings, considering a view taken horizontally and perpendicularly to the length of the railway track, and these two arms 15 and two members 14 always move simultaneously and in the same direction, whereas the other two arms 15 are behind the illustrated arm 11 when the device is viewed as indicated above and always move simultaneously with one another, anti-clockwise in moving the two members 14 which they carry from the first position to the second position.

The trolley carries its own engine and has a cabin in which an operator can sit. It if is desired to drive the first portions 7 of the clips into the passageways in the projections 5, the members 14 are swung into their second positions and the trolley moves along the railway track, stopping at each sleeper in turn. When it stops at a sleeper, the grippers 10 are actuated to grip the rail and the four arms 11 are simultaneously swung, two in one direction and two in the opposite direction, so that the pads 13 simultaneously drive the portions 7 of two clips in the same direction into two of the passageways and the portions 7 of two more clips in the opposite direction into two more of the passageways. Then the grippers 10 are released and with the pads 13 raised the trolley can move to the next sleeper. When it is desired to remove clips from their rail-securing positions, there are two possible modes of operation. One is to stop the trolley at each sleeper in turn and when it stops at one sleeper use the grippers 10 to grip the rail, then swing all four arms 15 so that the four members 14 push upon the four clips and drive their first portions out of the projections 5 (FIG. 3 shows one of the clips immediately after being ejected from one of the projections 5). The other mode of operation involves first driving the trolley along the track in one direction without stopping, driving out two clips from each sleeper, for example the illustrated clip and the clip on the nearside of the other rail, and then driving the trolley back in the reverse direction without stopping and in this journey driving out the other two clips on each sleeper. For this purpose, before each journey all four arms 15 are swung to their first positions and the means for swinging them to their second positions are then disabled so far as two of the arms are concerned, for example the illustrated one and the one on the nearside of the other rail. This disabling is effected by two pins 20 which fit in two sockets 21 and prevent two of the arms 15 from swinging to the second position when the corresponding two piston-and-cylinder devices 17 are actuated so as to tend to cause the arms 15 to swing. Then the two members 14 which have been prevented from swinging upwardly strike clips as the trolley travels in one direction and drive the first portions of two clips per sleeper out of the projections 5. A member 14 does not move to any substantial extent relatively to the trolley when it strikes one of the clips. Then the other two members 14 are brought to the first positions, the two pins 20 are removed from the two sockets 21 and inserted into other sockets so as to prevent the previously raised members 14 from being raised again when fluid at pressure is applied to all four piston-and-cylinder devices 17, tending to raise all four members 14. The trolley then travels along the track in the opposite direction and drives the first portions of the remaining two clips per sleeper out of the projections 5.

The arms 11 and 15 and the grippers 10 are carried on a structure 34—which is pivotally connected to the lower ends of arms 22 and 23, the upper ends of which are pivotally connected to the chassis 24 of the trolley. The four pivot axes are all parallel to one another and they intersect an imaginary plane, which is perpendicular to all of them, at four points 25 to 28 which lie at the corners of a parallelogram, as shown in FIG. 2, in which the parts 34 and 22 to 24 are also diagrammatically illustrated. By swinging the structure 34 upwardly and to the left, the grippers 10, the pads 13 and the members 14 are all raised without their orientation being changed. In this way one can cater for rails of different height. The structure 34 can be swung upwardly and to the left, and subsequently in the reverse direction, by a piston-and-cylinder device 29, of which the piston rod 30 is pivotally connected at 31 to the structure 34, whereas the cylinder is pivotally connected to the chassis 24.

Removal of the rail clips from rail-securing positions in a railway track of the kind specified could be the first move in a method of improving a railway track in which, after the clips have been removed using the device described above, part of the assembly on the track is adjusted, repaired or replaced, for example the sleepers and/or the rails may be replaced, and then the same clips or other clips are driven back into the projections, which of course means new projections if the sleepers are replaced by new ones.

Perhaps there is already known some trolley which has all the structural features specified in one or more of the appended claims but which is such that, when it travels along a horizontal railway track and the equivalent of said "member⇄ strikes a clip, the member would break off or be bent so that it cannot drive out the clip or at least cannot drive out further clips, or the trolley rebounds and comes to a halt without driving out the clip first encountered, or the trolley is not powerful enough to keep moving after driving out one clip or a few clips. All such trolleys are outside the spirit of the present invention and are intended to be outside the scope of all the present claims, which are intended to cover only devices which can, without coming to a halt, travel along a horizontal railway track and, in so doing, drive out hundreds of clips.

I claim:

1. A device suitable for use in removing rail clips from rail-securing positions in a railway track of the type comprising two rails each having, at intervals along it, two upwardly-extending projections on opposite sides of the rail for locating the rail, at least one of each two projections having driven into it a first portion of a rail clip, which first portion is substantially parallel to the rail, the clip having a second portion bearing downwardly on the top of a flange of the rail, a third portion bearing downwardly on an unyielding surface which is on that side of the first portion of the clip remote from the rail, a fourth portion interconnecting said first portion with one of said second and third portions, and a fifth portion interconnecting said second and third portions, at least one of said fourth and fifth portions extending above said upwardly-extending projection, the device comprising a trolley constructed to run on at least one rail of the track and carrying a member which is adjustable to a position such that when the trolley runs along the track in an appropriate direction the member strikes one of said fourth and fifth portions of all the clips on one side of one of the rails and forces their first portions out of the projections, the member being fixed, or having means for fixing it, so that it does not move relative to the trolley when it strikes one of the clips.

2. A device according to claim 1, further comprising means carried by the trolley and operable, upon the trolley stopping at each two upwardly-extending projections, for driving the first portions of the clip into the projections.

3. A device suitable for use in removing rail clips from rail-securing positions in a railway track of the type comprising two rails each having, at intervals along it, two upwardly-extending projections on opposite sides of the rail for locating the rail, at least one of each two projections having driven into it a first portion of a rail clip, which first portion is substantially parallel to the rail, the clip having a second portion bearing downwardly on the top of a flange of the rail, a third portion bearing downwardly on an unyielding surface which is on that side of the first portion of the clip remote from the rail, a fourth portion interconnecting said first portion with one of said second and third portions, and a fifth portion interconnecting said second and third portions, at least one of said fourth and fifth portions extending above said upwardly-extending projection, the device comprising a trolley constructed to run on at least one rail of the track and carrying a member which is adjustable to a first position such that when the trolley runs along the track in an appropriate direction the member strikes one of said fourth and fifth portions of all the clips on one side of one of the rails and forces their first portions out of the projections, the trolley carrying actuating means for moving said member out of said first position to a second position in which it could not strike the clips when the trolley runs along the track, and means for disabling said actuating means when required so that, despite operation of said actuating means in a sense tending to move said member out of the first position to the second position, it does not move to the second position.

4. A device suitable for use in removing rail clips from rail-securing positions in a railway track of the type comprising two rails each having, at intervals along it, two upwardly-extending projections on opposite sides of the rail for locating the rail, at least one of each two projections having driven into it a first portion of a rail clip, which first portion is substantially parallel to the rail, the clip having a second portion bearing downwardly on the top of a flange of the rail, a third portion bearing downwardly on an unyielding surface which is on that side of the first portion of the clip remote from the rail, a fourth portion interconnecting said first portion with one of said second and third portions, and a fifth portion interconnecting said second and third portions, at least one of said fourth and fifth portions extending above said upwardly-extending projection, the device comprising a trolley constructed to run on at least one rail of the track and carrying two members which lie on opposite sides of one of the rails when the device is running along the track, each of these members being adjustable to a first position such that when the trolley runs along the track in an appropriate direction, which in the case of one member is opposite to the direction which is appropriate for the other member, the member strikes one of said fourth and fifth portions of all the clips on one side of one of the rails and forces their first portions out of the projections, there being actuating means which is capable of moving both said members simultaneously in opposite directions out of the first positions to second positions in which they could not strike, the clips when the trolley runs along the track, and means for, when required, disabling the actuating means in so far as it acts on one of the members so that that member does not move to the second position.

5. A device according to claim 4, in which the actuating means comprises a first piston-and-cylinder device coupled to one of the members to move it between the first and second positions, a second piston-and-cylinder device coupled to the other member to move it between the first and second positions simultaneously with said one member, so that both said piston and cylinder devices tend to operate in unison to move the members from the first positions to the second positions, said disabling means comprising abutment means for preventing one of the members from being moved by its piston-and-cylinder device.

6. A device according to claim 5, in which each of said members moves between the first and second positions by swinging about an axis which is horizontal and extends across the track perpendicularly to it.

7. A device according to claim 4, in which each of said members moves between the first and second positions by swinging about an axis which is horizontal and extends across the track perpendicularly to it.

8. A device suitable for use in removing rail clips from rail-securing positions in a railway track of the type comprising two rails each having, at intervals along it, two upwardly-extending projections on opposite sides of the rail for locating the rail, at least one of each two projections having driven into it a first portion of a rail clip, which first portion is substantially parallel to the rail, the clip having a second portion bearing downwardly on the top of a flange of the rail, a third portion bearing downwardly on an unyielding surface which is on that side of the first portion of the clip remote from the rail, a fourth portion interconnecting said first portion with one of said second and third portions, and a fifth portion interconnecting said second and third portions, at least one of said fourth and fifth portions extending above said upwardly-extending projection, the device comprising a trolley constructed to run on at least one rail of the track and carrying a member which is adjustable to a position such that when the trolley runs along the track in an appropriate direction the member strikes one of the fourth and fifth portions of all the clips on one side of one of the rails and forces their first portions out of the projections, the member being mounted on a structure to which first and second swinging parts are pivotally connected, the first and second swinging parts also being pivotally connected to the trolley, the pivot axes of these four pivotal connections all being parallel and being such as to intersect an imaginary plane, perpendicular to the axes, at points which lie at the corners of a parallelogram, whereby when the first and second swinging parts are swung about the axes of the pivotal connections to the trolley said member is raised and lowered so that it can be adjusted to said position, the member being fixed, or having means for fixing it, so that it does not move relative to the trolley when it strikes one of the clips.

9. A method of removing rail clips from rail-securing positions in a railway track of the type comprising two rails each having, at intervals along it, two upwardly-extending projections on opposite sides of the rail for locating the rail, at least one of each two projections having driven into it a first portion of a rail clip, which first portion is substantially parallel to the rail, the clip having a second portion bearing downwardly on the top of a flange of the rail, a third portion bearing downwardly on an unyielding surface which is on that side of the first portion of the clip remote from the rail, a fourth portion interconnecting said first portion with one of said second and third portions, and a fifth portion interconnecting said second and third portions, at least one of said fourth and fifth portions extending above said upwardly-extending projection, said method comprising:

operating a trolley to run along the track, adjusting an adjustable member which is carried by the trolley to a position such that as the trolley moves along the track the member strikes one of said fourth and fifth portions of all the clips on one side of one of the rails and forces their first portions out of the projections so as to remove the clips, and fixing the member against movement out of said position so that it does not move relative to the trolley when it strikes one of the clips.

10. A method of improving a railway track of the type comprising two rails each having, at intervals along it, two upwardly-extending projections on opposite sides of the rail for locating the rail, at least one of each two projections having driven into it a first portion of a rail clip, which first portion is substantially parallel to the rail, the clip having a second portion bearing downwardly on the top of a flange of the rail, a third portion bearing downwardly on an unyielding surface which is on that side of the first portion of the clip remote from the rail, a fourth portion interconnecting said first portion with one of said second and third portions, and a fifth portion interconnecting said second and third portions, at least one of said fourth and fifth portions extending above said upwardly-extending projection, said method comprising:

operating a trolley to run along the track, adjusting an adjustable member which is carried by the trolley to a position such that as the trolley moves along the track the member strikes one of said fourth and fifth portions of all the clips on one side of one of the rails and forces their first portions out of the projections so as to remove the clips, fixing the member against movement out of said position so that it does not move relative to the trolley when it strikes one of the clips, carrying out desired improvement operations on part of the assembly on the track, and then driving a clip back into each projection from which a clip has been removed.

* * * * *